US010041383B2

(12) United States Patent
Yano et al.

(10) Patent No.: US 10,041,383 B2
(45) Date of Patent: Aug. 7, 2018

(54) VARIABLE VALVE MECHANISM

(71) Applicant: TOYOTA JIDOSHA KABUSHIKI KAISHA, Toyota-shi (JP)

(72) Inventors: Toshiyuki Yano, Nagakute (JP); Yu Yokoyama, Okazaki (JP); Toru Sakuma, Nisshin (JP); Yuta Nishimura, Toyota (JP); Atsuhisa Tamano, Anjo (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 149 days.

(21) Appl. No.: 15/298,654

(22) Filed: Oct. 20, 2016

(65) Prior Publication Data

US 2017/0122136 A1 May 4, 2017

(30) Foreign Application Priority Data

Oct. 30, 2015 (JP) ..... 2015-213695

(51) Int. Cl.
*F01L 1/34* (2006.01)
*F01L 1/04* (2006.01)
(Continued)

(52) U.S. Cl.
CPC ..... *F01L 1/34* (2013.01); *F01L 1/04* (2013.01); *F01L 1/053* (2013.01); *F01L 13/0036* (2013.01); *F01L 1/185* (2013.01); *F01L 1/2405* (2013.01); *F01L 1/267* (2013.01); *F01L 2001/0476* (2013.01); *F01L 2013/0052* (2013.01); *F01L 2013/101* (2013.01); *F01L 2105/00* (2013.01)

(58) Field of Classification Search
CPC ..... F01L 1/34; F01L 1/04; F01L 1/053; F01L 1/185; F01L 1/267; F01L 13/0036; F01L 2013/101; F01L 2013/0052; F01L 2001/0476; F01L 2105/00
See application file for complete search history.

(56) References Cited

U.S. PATENT DOCUMENTS 8,931,444 B2 1/2015 McConville et al.
9,074,499 B2 7/2015 Woo et al.
(Continued)

FOREIGN PATENT DOCUMENTS

JP 2010-520395 6/2010
JP 2014-134165 A 7/2014
JP 2014-227864 A 12/2014

*Primary Examiner* — Zelalem Eshete
(74) *Attorney, Agent, or Firm* — Oblon, McClelland, Maier & Neustadt, L.L.P.

(57) ABSTRACT

A variable valve mechanism includes a first cam unit including cams configured to drive an intake valve on a first side in a first cylinder; a first sliding mechanism configured to slide the first cam unit such that the first cam unit is switched between two positions to select any one of the cams; a second cam unit including cams configured to drive an intake valve on a second side in the first cylinder, cams configured to drive an intake valve on the first side in a second cylinder, and cams configured to drive an intake valve on the second side in the second cylinder; and a second sliding mechanism configured to slide the second cam unit such that the second cam unit is switched among three positions to select any one of the cams for each of the intake valves.

5 Claims, 8 Drawing Sheets

(51) Int. Cl.

| | |
|---|---|
| ***F01L 1/053*** | (2006.01) |
| ***F01L 13/00*** | (2006.01) |
| *F01L 1/18* | (2006.01) |
| *F01L 1/24* | (2006.01) |
| *F01L 1/26* | (2006.01) |
| *F01L 1/047* | (2006.01) |

(56) References Cited

U.S. PATENT DOCUMENTS

| | | | | |
|---|---|---|---|---|
| 2010/0269769 | A1 | 10/2010 | Schoeneberg et al. | |
| 2013/0047944 | A1* | 2/2013 | Schwarzenthal ..... | F01L 1/047<br>123/90.18 |
| 2013/0104824 | A1 | 5/2013 | Weinmeister | |

* cited by examiner

VARIABLE VALVE MECHANISM

INCORPORATION BY REFERENCE

The disclosure of Japanese Patent Application No. 2015-213695 filed on Oct. 30, 2015 including the specification, drawings and abstract is incorporated herein by reference in its entirety.

BACKGROUND OF THE INVENTION

1. Field of the Invention

The present invention relates to a variable valve mechanism used for a valve system or the like of an engine, for example, and particularly relates to a cam-switching variable valve mechanism configured to select any one of a plurality of cams by sliding a cam unit in an axial direction (a cam axial direction), the cam unit being provided around a camshaft.

2. Description of Related Art

Conventionally, as a variable valve mechanism that can change a lift characteristic of an intake valve or an exhaust valve of an engine, a Variable Valve Timing (VVT) that can continuously change a valve timing is used widely. Further, as described in Published Japanese Patent Translation of PCT application No. 2010-520395 (JP 2010-520395 A), for example, there has been publicly known a cam-switching variable valve mechanism configured such that a cam carrier (a cam unit) including a plurality of cams is provided around a camshaft, and any one of the cams is selected by sliding the cam carrier in an axial direction of the camshaft.

The variable valve mechanism of the conventional example is provided in a multi-cylinder engine in which two intake valves and two exhaust valves are provided for each cylinder. In a cam carrier provided for each cylinder around an intake camshaft, three cams, i.e., a large cam, an intermediate cam, and a small cam are provided for each of the two intake valves. The cam carrier is slid in a cam axial direction so as to switch among a low lift position at which the small cam is selected, an intermediate lift position at which the intermediate cam is selected, and a high lift position at which the large cam is selected.

SUMMARY OF THE INVENTION

In the meantime, in order to increase the mountability on a vehicle, a demand for reducing the size of the engine has been increasing in the recent years. In order to shorten an overall length of the engine, a distance between a first journal that holds an intake camshaft in a front (an end portion on a first side in the cam axial direction) of a valve system and a cam that drives an intake valve on a front side (the first side in the cam axial direction) in a first cylinder is extremely small.

On this account, when a lift characteristic of the intake valve is changed in three stages by sliding a cam carrier such that the cam carrier is switched among three positions in the cam axial direction, as described in the conventional example, a slide amount of the cam carrier for the switching becomes large. Accordingly, the cam carrier for the first cylinder may interfere with the first journal.

The present invention makes it possible to change an intake valve lift characteristic in three stages by sliding a cam unit (a cam carrier) even in a case where a space in one end of a valve system of an engine is narrow.

According to an aspect of the present invention, a first cam unit for an intake valve on a first side in a cam axial direction in a first cylinder is separated from a second cam unit for an intake valve on a second side. The intake valve on the second side is switched among three stages by the second cam unit, whereas the intake valve on the first side is switched between two stages by the first cam unit, and thus, the slide amount of the first cam unit is made small.

More specifically, the aspect of the present invention relates to a variable valve mechanism provided in a multi-cylinder engine in which at least two cylinders including a first cylinder and a second cylinder are provided in a stated order from a first side to a second side opposite to the first side in a cam axial direction and two intake valves are provided for each of the at least two cylinders, the variable valve mechanism being configured to drive the intake valves.

The variable valve mechanism includes a first cam unit provided around an intake camshaft and including a plurality of cams configured to drive the intake valve on the first side in the cam axial direction in the first cylinder; a first sliding mechanism configured to slide the first cam unit in the cam axial direction such that the first cam unit is switched between two positions to select any one of the plurality of cams; a second cam unit provided around the intake camshaft and including a plurality of cams configured to drive the intake valve on the second side in the cam axial direction in the first cylinder, a plurality of cams configured to drive the intake valve on the first side in the cam axial direction in the second cylinder, and a plurality of cams configured to drive the intake valve on the second side in the cam axial direction in the second cylinder; and a second sliding mechanism configured to slide the second cam unit in the cam axial direction such that the second cam unit is switched among three positions to select any one of the plurality of cams for each of the intake valve on the second side in the cam axial direction in the first cylinder, the intake valve on the first side in the cam axial direction in the second cylinder, and the intake valve on the second side in the cam axial direction in the second cylinder.

In the variable valve mechanism configured as described above, the first sliding mechanism slides the first cam unit to any one of the two positions so as to select any one of the plurality of (e.g., two) cams, and thus, a lift characteristic of the intake valve on the first side in the first cylinder can be changed in two stages. Further, the second sliding mechanism slides the second cam unit to any of the three positions so as to select any of the plurality of (e.g., two or three) cams for each of the intake valve on the second side in the first cylinder and the two intake valves for the second cylinder. This makes it possible to change lift characteristics of these intake valves in three stages.

That is, with regard to the first cylinder, the lift characteristic of the intake valve on the first side is changed in the two stages and the lift characteristic of the intake valve on the second side is changed in the three stages. Thus, in the entire first cylinder for which both of the intake valves on the first side and the second side are provided, the intake valve lift characteristic can be changed in the three stages. Further, since the first cam unit is slid between the two positions, the slide amount of the first cam unit can be made small as compared to a case where a cam unit is slid among three positions. Accordingly, interference with the first journal can be prevented.

In order that the lift characteristics of the intake valves for the first cylinder and the second cylinder are made uniform, the lift characteristic of the intake valve on the first side in the second cylinder may be changed in two stages, instead of three stages. For this purpose, as the plurality of cams configured to drive the intake valve on the first side in the second cylinder, cams having the same profiles as the profiles of the plurality of cams configured to drive the intake valve on the first side in the first cylinder may be provided.

More specifically, in the first cam unit, a small cam and a large cam larger than the small cam may be provided. In the second cam unit, the small cam, the large cam, and an intermediate cam having a size between a size of the small cam and a size of the large cam may be provided for each of the intake valve on the second side in the cam axial direction in the first cylinder and the intake valve on the second side in the cam axial direction in the second cylinder, and the small cam and the large cam may be provided for the intake valve on the first side in the cam axial direction in the second cylinder.

That is, in the second cam unit, two small cams and one large cam may be provided or one small cam and two large cams may be provided for the intake valve on the first side in the second cylinder. In this case, one of the two small or large cams may be selected for the intake valve on the first side in the second cylinder at a position where the intermediate cams are selected for the intake valves on the second side in the first cylinder and the second cylinder.

Alternatively, in the second cam unit, one small cam and one large cam may be provided for the intake valve on the first side in the second cylinder. In this case, one of the cams may be provided so as to have a cam width wider than (e.g., twice as large as) the cam width of the other one of the cams. Then, the cam with the wider cam width may be selected for the intake valve on the first side in the second cylinder at a position where the intermediate cams are selected for the intake valves on the second side in the first cylinder and the second cylinder.

Further, the first sliding mechanism and the second sliding mechanism may be configured to slide the first cam unit and the second cam unit in synchronization with each other. With this configuration, the lift characteristics of all the intake valves in the first cylinder and the second cylinder can be changed at the same timing. Accordingly, it is possible to avoid occurrence of a situation in which a large variation in an intake air charging amount between the cylinders is caused when the lift characteristics of the intake valves are changed.

Further, a predetermined gap (e.g., a gap corresponding to twice as large as a dimensional tolerance of the cam unit) may be formed between the first cam unit and the second cam unit when the first cam unit is placed at a second position on the second side out of the two positions including a first position on the first side and the second position on the second side in the cam axial direction and the second cam unit is placed at a central position among the three positions including a third position on the first side, a fourth position on the second side, and the central position between the third position on the first side and the fourth position on the second side in the cam axial direction.

With this configuration, when the first cam unit is switched to the first position on the first side, the first cam unit does not interfere with the second cam unit regardless of the position of the second cam unit. Further, even in a case where the first cam unit is switched to the second position on the second side, when the second cam unit is switched to the central position or the fourth position on the second side, they do not interfere with each other. Therefore, the lift characteristics of the intake valves can be changed by sliding the first and second cam units with the use of the first and second sliding mechanisms.

Meanwhile, in a case where a failure occurs in the first sliding mechanism and the first cam unit is stopped at the second position on the second side in the cam axial direction, when the second cam unit is slid from the central position by the second sliding mechanism so as to be switched to the third position on the first side in the cam axial direction, the first cam unit is pressed by the second cam unit so as to be switched to the first position on the first side in the cam axial direction. That is, a fail-safe against the failure in the first sliding mechanism is implemented.

In the variable valve mechanism according to the above aspect of the present invention, the cam configured to drive the intake valve on the second side in the first cylinder of the engine is separated so as to be integrated with the second cam unit for the second cylinder, and the lift characteristic of the intake valve on the second side in the first cylinder is changed in three stages by sliding the second cam unit. Further, the first cam unit configured to drive the intake valve on the first side in the first cylinder is switched between two stages, thereby making it possible to decrease the slide amount of the first cam unit. As a result, even in a case where a space in one end of a valve system of the engine is narrow, it is possible to change the intake valve lift characteristic in three stages by sliding the cam unit.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
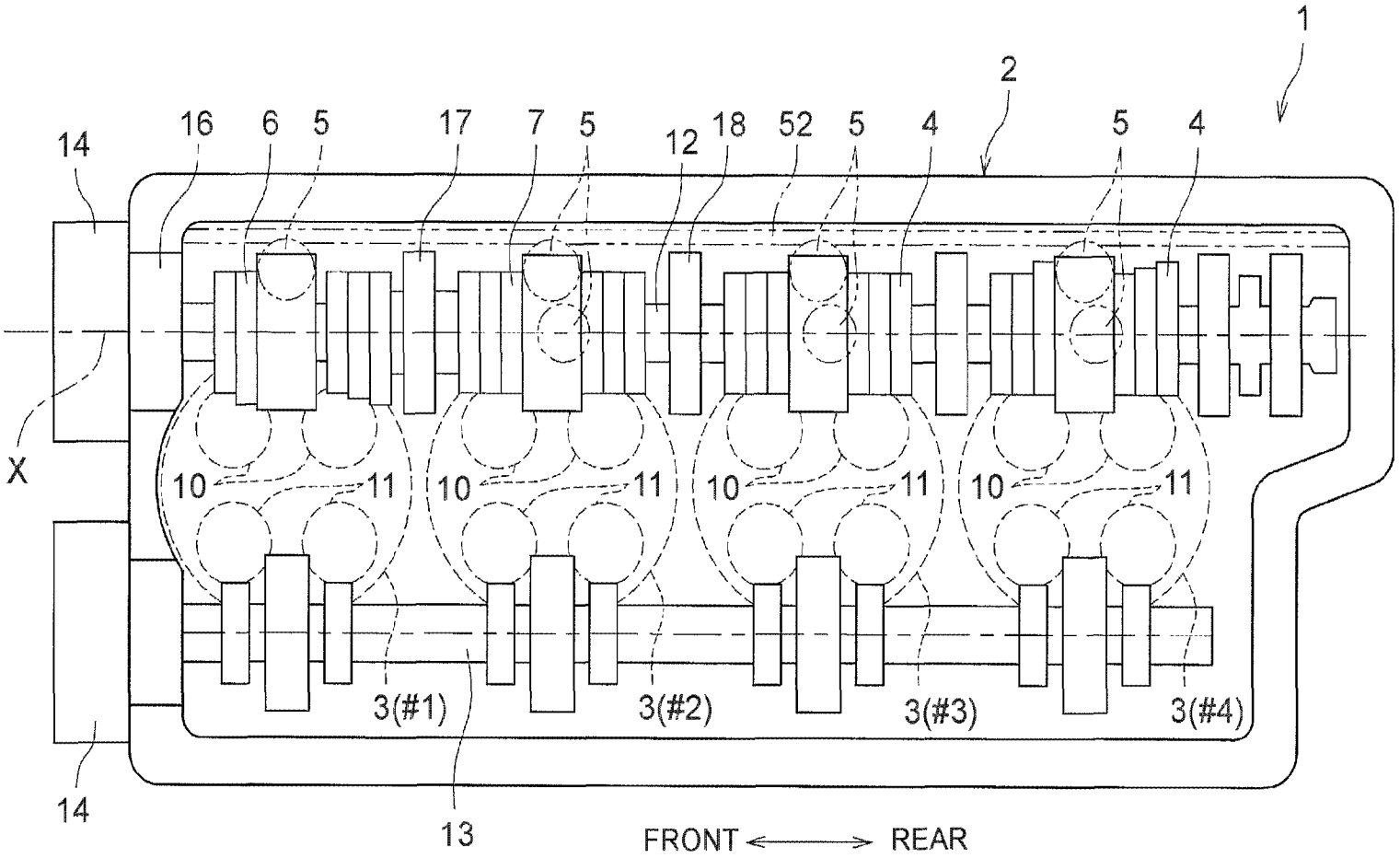
FIG. 1 is a schematic configuration diagram of a valve system of an engine provided with a variable valve mechanism according to an embodiment of the present invention.

The following describes an embodiment in which the present invention is applied to a valve system of an engine, with reference to the drawings. An engine 1 of the present embodiment is an in-line four-cylinder gasoline engine 1 as an example. As schematically illustrated in FIG. 1, four cylinders, i.e., first to fourth cylinders 3 (#1 to #4) are arranged in a longitudinal direction of a cylinder block (not shown), i.e., in a front-rear direction (a right-left direction indicated by an arrow in FIG. 1) of the engine 1. Note that, in the following description, the front-rear direction of the engine 1 is simply referred to as the front-rear direction.

As shown in FIG. 1, when viewed from above, a cam housing 2 is disposed on an upper part (a cylinder head) of the engine 1, so as to accommodate valve systems of intake valves 10 and exhaust valves 11. That is, as indicated by a broken line in FIG. 1, the four cylinders 3 arranged in line in the front-rear direction of the engine 1 are each provided with two intake valves 10 and two exhaust valves 11, which are driven by an intake camshaft 12 and an exhaust camshaft 13, respectively.

Front ends of the intake camshaft 12 and the exhaust camshaft 13 are provided with respective Variable Valve Timings (VVTs) 14 that can continuously change valve timings. Further, since a large load is applied to a first journal 16 that holds the front end of the intake camshaft 12, the width of the first journal 16 is wider than the width of each of a second journal 17 and a third journal 18. Further, the intake camshaft 12 is provided with a cam switch mechanism (a variable valve mechanism of the present invention) that changes a lift characteristic of the intake valve 10 by switching among cams 40 to 42 (see FIG. 2) that drive the intake valve 10. The cam switch mechanism is provided for each cylinder 3.

Figure 2:
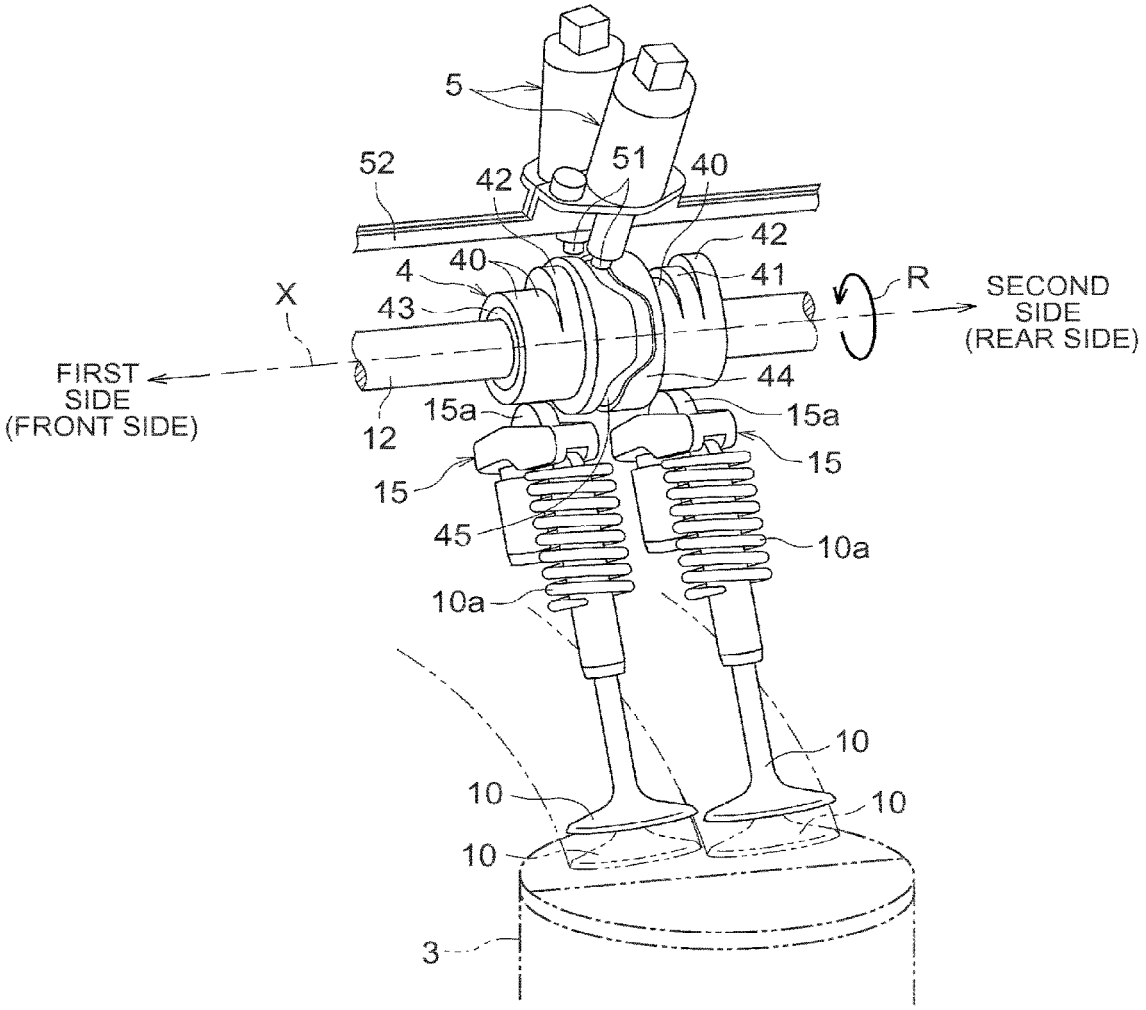
FIG. 2 is a perspective view illustrating a basic configuration of a valve system on an intake side.

As one example, as illustrated in FIG. 2 that illustrates the third cylinder 3 (#3) in an enlarged manner, two or three cams 40 to 42 having different profiles are provided for each of two intake valves 10 arranged in a direction of an axis X of the intake camshaft 12 in each cylinder 3, and any of the cams 40 to 42 drives the corresponding intake valve 10 via a rocker arm 15. The direction of the axis X of the intake camshaft 12 (the X-axis direction) is a cam axial direction, and hereinafter, may be referred to as the front-rear direction. Note that, in the following description, a small cam that is relatively small is referred to as a low lift cam 40, a large cam that is relatively large is referred to as a high lift cam 42, and an intermediate cam that has a medium size between the size of the low lift cam 40 and the size of the high lift cam 42 is referred to as an intermediate lift cam 41.

For example, as illustrated in FIG. 2, in the third cylinder 3 (#3), two low lift cams 40 and one high lift cam 42 are arranged in the front-rear direction for the intake valve 10 on a front side of the engine 1 (a left side in FIG. 2, i.e., a first side in the X-axis direction). Further, a low lift cam 40, an intermediate lift cam 41, and a high lift cam 42 are arranged in the front-rear direction for the intake valve 10 on a rear side (a right side in FIG. 2, i.e., a second side in the X-axis direction).

Base circles of the low lift cam 40, the intermediate lift cam 41, and the high lift cam 42 have the same diameter, and are formed as arc surfaces continuous with each other. FIG. 2 illustrates a state where the low lift cam 40 is selected, and a roller 15*a* of the rocker arm 15 contacts a base circle zone of the low lift cam 40, and the roller 15*a* is pressed against the low lift cam 40 by a reaction force of a valve spring 10*a* of the intake valve 10. In a state where the roller 15*a* of the rocker arm 15 thus contacts the base circle zone, the intake valve 10 does not lift.

When the intake camshaft 12 rotates in a direction indicated by an arrow R, a cam lobe of the low lift cam 40 presses the roller 15*a* so as to push down the rocker arm 15, although not illustrated herein. This causes the rocker arm 15 to drive the intake valve 10 in accordance with the profile of the cam lobe, and thus, the intake valve 10 lifts, as indicated by a virtual line in FIG. 2, against the reaction force of the valve spring 10*a*.

Figure 3:
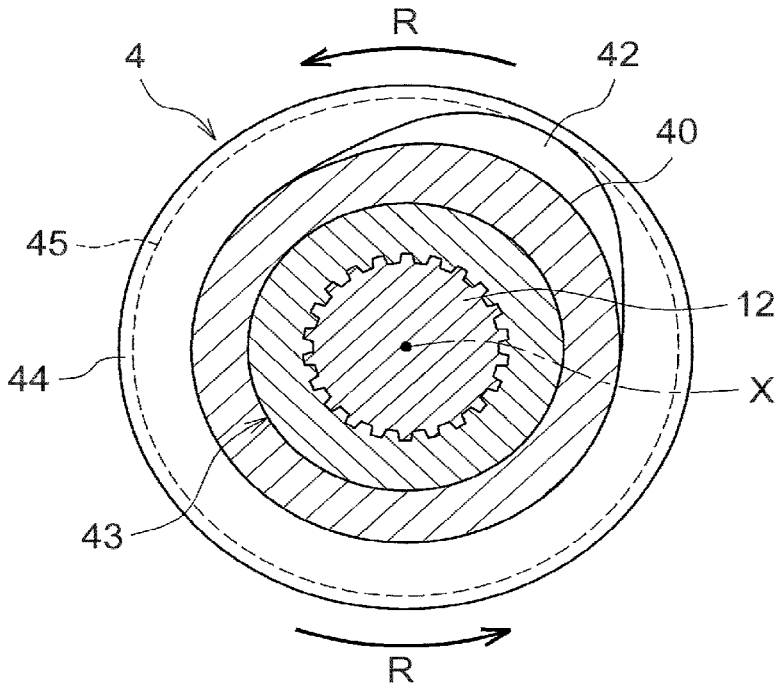
FIG. 3 is a cross-sectional view of a cam unit provided around an intake camshaft.
Figure 4:
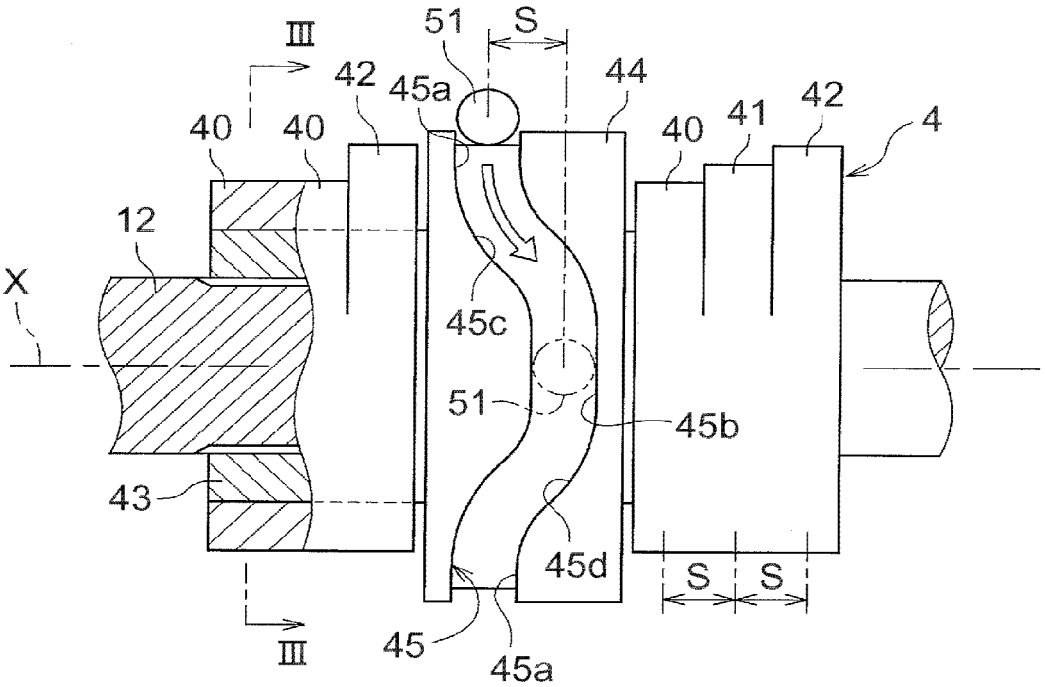
FIG. 4 is a partial sectional view illustrating a structure of the cam unit.

In the present embodiment, a cam that lifts the intake valve 10 via the rocker arm 15 is switched among the low lift cam 40, the intermediate lift cam 41, and the high lift cam 42, as described above. That is, as illustrated in FIGS. 3 and 4, in addition to FIG. 2, the two or three cams 40 to 42 are formed integrally with each other and fitted to an end portion of a cylindrical sleeve 43 in the X-axis direction. The sleeve 43 is slidably provided around the intake camshaft 12.

As illustrated in a cross section perpendicular to the axis X in FIG. 3, internal teeth of a spline are formed on an inner periphery of the sleeve 43 of the cam unit 4 and mesh with external teeth of a spline formed on an outer periphery of the intake camshaft 12. That is, the cam unit 4 (the sleeve 43) is spline-connected to the intake camshaft 12, and the cam unit 4 rotates integrally with the intake camshaft 12 and slides thereon in the X-axis direction (the front-rear direction).

In order to slide the cam unit 4 as described above, a guide groove 45 to be engaged with a shift pin 51 is provided on an outer periphery of the cam unit 4, as described below. That is, in the present embodiment, an annular large-diameter member 44 having an outside diameter larger than a cam lobe of the high lift cam 42 is fitted to an intermediate part of the sleeve 43 in the X-axis direction, and the guide groove 45 extending in a circumferential direction is provided over a whole circumference of an outer periphery of the large-diameter member 44.

As illustrated in FIG. 2, at least one actuator 5 is provided for each cylinder 3 so as to be disposed above the intake camshaft 12. Each actuator 5 is configured to drive the shift pin 51 such that the shift pin 51 reciprocates (i.e., the shift pin 51 advances and moves back). Each actuator 5 is supported by the cam housing 2 via a stay 52 extending in the front-rear direction of the engine 1. Each actuator 5 drives the corresponding shift pin 51 by an electromagnetic solenoid. When the actuator 5 is in an ON state, the shift pin 51 advances so as to be engaged with the guide groove 45.

When the shift pin 51 advances so as to be engaged with the guide groove 45, the shift pin 51 relatively moves on an outer peripheral surface of the cam unit 4 in the circumferential direction, and also moves in the X-axis direction, namely, moves diagonally as indicated by an arrow in FIG. 4, along with rotation of the intake camshaft 12. This will be described below with reference to FIG. 5. At this time, the cam unit 4 practically rotates and slides relative to the shift pin 51 in the X-axis direction. Thus, the cam unit 4 is switched to any of a low lift position, an intermediate lift position, and a high lift position.

More specifically, as illustrated in FIG. 4, the guide groove 45 includes straight grooves 45*a*, 45*b* respectively provided closer to the first side and the second side (the front side and the rear side) in the X-axis direction in the large-diameter member 44 of the sleeve 43 such that the straight grooves 45*a*, 45*b* linearly extend in the circumferential direction; and S-shaped curved grooves 45*c*, 45*d* that connect the straight grooves 45*a*, 45*b* to each other. When the low lift cam 40 is selected as illustrated in FIG. 2 (when the cam unit 4 is placed at the low lift position), the front-side straight groove 45*a* faces the shift pin 51 of the rear-side actuator 5.

Figure 5:
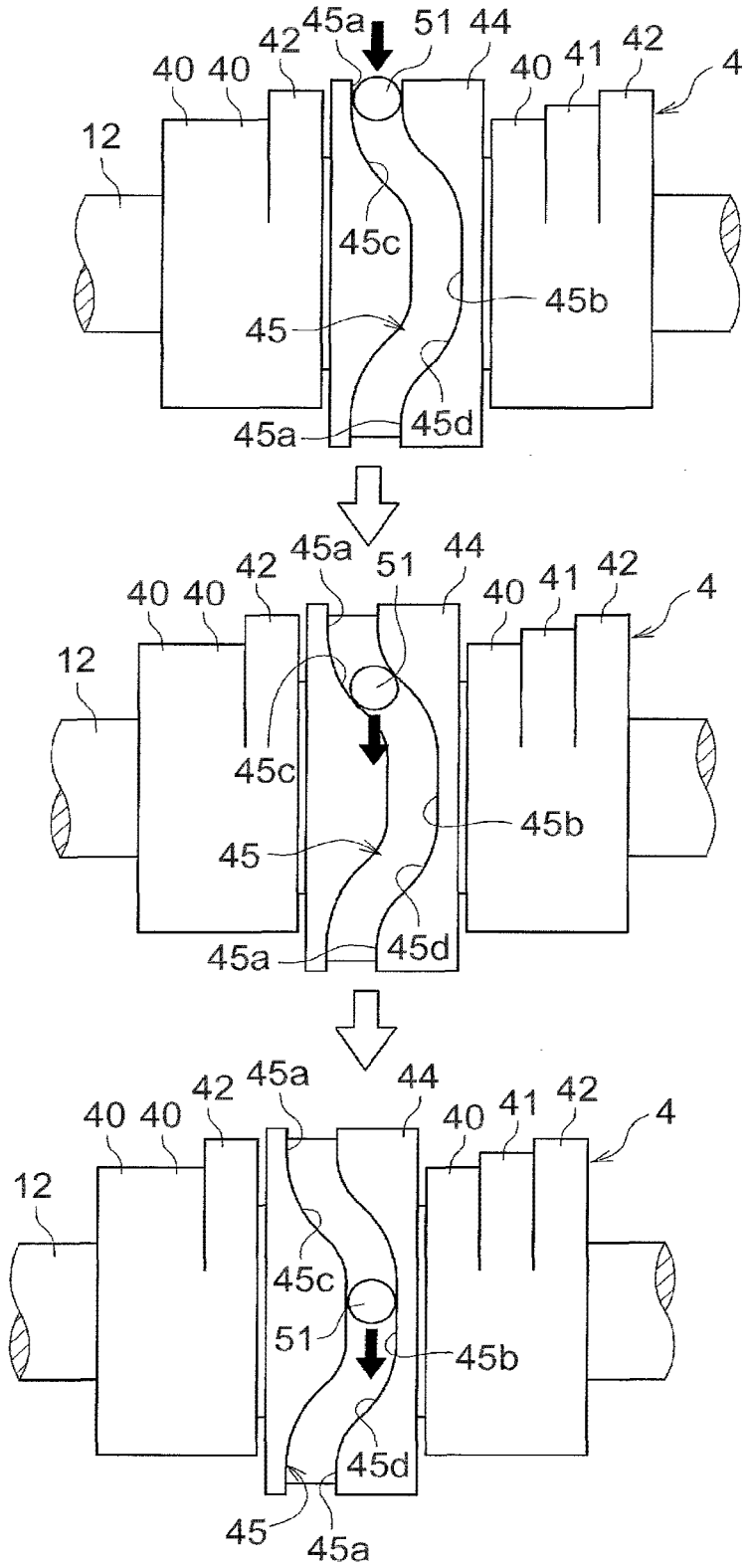
FIG. 5 is a view illustrating a basic configuration and an operation of a cam switch mechanism in which the cam unit is slid by engaging a shift pin with a guide groove.

When the rear-side actuator 5 is turned on in this state, the shift pin 51 that advances as illustrated in an upper side in FIG. 5 engages with the front-side straight groove 45*a* of the guide groove 45. Along with the rotation of the intake camshaft 12 as indicated by the arrow R in FIG. 2, the shift pin 51 moves along the front-side straight groove 45*a* and then reaches the curved groove 45*c* as illustrated in a center in FIG. 5. The shift pin 51 then relatively moves toward the rear side along the curved groove 45*c*, and thus, the shift pin 51 practically presses the cam unit 4 toward the front side such that the cam unit 4 slides toward the front side.

When the cam unit 4 slides toward the front side and the shift pin 51 reaches the rear-side straight groove 45*b* as illustrated in a lower side in FIG. 5, the cam unit 4 is switched to the intermediate lift position. Thus, the shift pin 51 is moved back so as to be disengaged from the guide groove 45. At the intermediate lift position, the rear-side small lift cam 40 is selected from the two small lift cams 40 for the front-side intake valve 10, and the intermediate lift cam 41 is selected for the rear-side intake valve 10. Thus, the cylinder 3, as a whole, is brought to an intermediate lift state between a small lift state and a large lift state.

After the cam unit 4 is switched to the intermediate lift position as described above, the front-side actuator 5 (on the first side in the X-axis direction) is then turned on so as to cause the shift pin 51 to advance in a manner similar to the above-described manner. Thus, the shift pin 51 engages with the front-side straight groove 45*a* and relatively moves to the rear-side straight groove 45*b* along a curved shape of the guide groove 45, although not illustrated herein. Thus, the cam unit 4 practically slides toward the front side, and thus, the cam unit 4 is switched to the high lift position.

Note that a slide amount S (illustrated in FIG. 4) of the cam unit 4 at the time when the cam unit 4 is switched from the low lift position to the intermediate lift position or from the intermediate lift position to the high lift position is the same as a distance between the low lift cam 40 and the intermediate lift cam 41 or a distance between the intermediate lift cam 41 and the high lift cam 42. Further, although not illustrated in the figure, a mechanism for maintaining a position of the cam unit 4 in any of the low lift position, the intermediate lift position, and the high lift position is provided between the cam unit 4 and the intake camshaft 12.

Further, although detailed explanations are omitted, in the case where the cam unit 4 is placed at the high lift position, when the front-side actuator 5 is turned on so as to engage the corresponding shift pin 51 with the rear-side straight groove 45*b* of the guide groove 45, the cam unit 4 can be slid toward the rear side so as to be returned to the intermediate lift position. Similarly, when the shift pin 51 corresponding to the rear-side actuator 5 is engaged with the guide groove 45 of the cam unit 4 placed at the intermediate lift position, the cam unit 4 can be returned to the low lift position.

Next, cam switch mechanisms for the first cylinder 3 (#1) and the second cylinder 3 (#2) will be described as a characteristic configuration of the present embodiment. The engine 1 of the present embodiment has an overall length that is shortened as much as possible in order to increase its mountability on a vehicle. For this reason, a distance between the first journal 16 (see FIG. 1) that holds the front part of the intake camshaft 12 and the front-side intake valve 10 for the first cylinder 3 (#1) is extremely small.

On this account, if the aforementioned cam unit 4 is provided for the first cylinder 3 (#1) and is slid along the intake camshaft 12 so as to be switched to any one of the low lift position, the intermediate lift position, and the high lift position (that is, the cam unit 4 for the first cylinder 3 (#1) is switched in three stages), the slide amount for switching in the three stages becomes large, and as a result, the cam unit 4 may interfere with the first journal 16.

In this regard, in the present embodiment, a first cam unit 6 only for the front-side intake valve 10 for the first cylinder 3 (#1) is provided, and cams 70 to 72 configured to drive the rear-side intake valve 10 for the first cylinder 3 (#1) are integrated with a second cam unit 7 for the second cylinder 3 (#2). The second cam unit 7 is switched in three stages similarly to the cam unit 4 for the aforementioned third cylinder 3 (#3) or the like, whereas the first cam unit 6 is switched in two stages such that the slide amount of the first cam unit 6 is made small.

Figure 6:
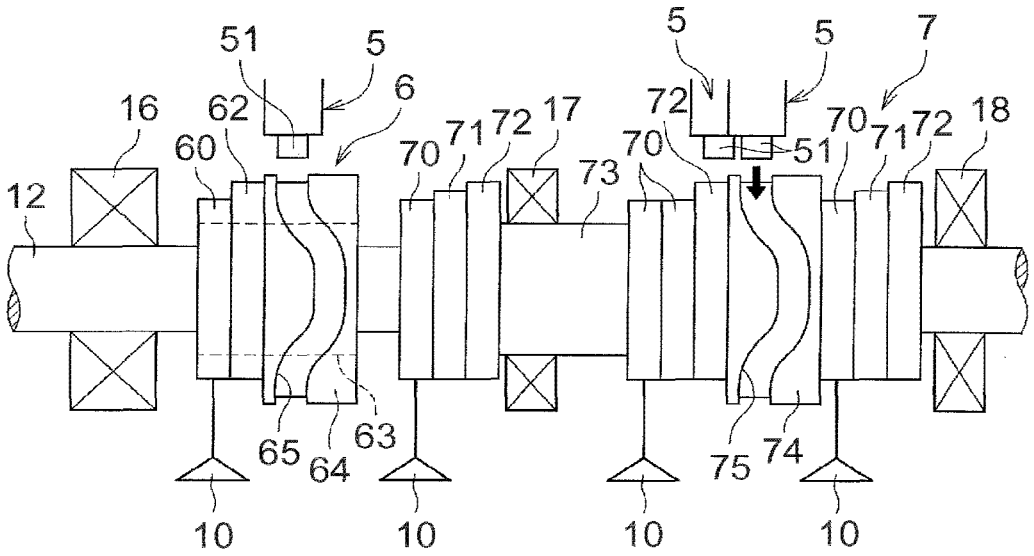
FIG. 6 is a view schematically illustrating a configuration of first and second cam units, FIG. 6 illustrating a low lift state.

FIG. 6 schematically illustrates the first and second cam units 6, 7. As illustrated in FIG. 6, the first cam unit 6 has a structure obtained by removing a rear part of the aforementioned cam unit 4 for the third cylinder 3 (#3) such that a front part and a central part thereof are left. A low lift cam 60 and a high lift cam 62 configured to drive the front-side intake valve 10 for the first cylinder 3 (#1) are fitted to a front end of a sleeve 63 of the first cam unit 6.

Note that a basic structure of the sleeve 63 in the first cam unit 6 is similar to the aforementioned sleeve 43 for the third cylinder 3 (#3) or the like. The sleeve 63 is spline-connected to the intake camshaft 12, and a large-diameter member 64 that is similar to the large-diameter member 44 is fitted to the sleeve 63. Further, a guide groove 65 having the same shape as the shape of the guide groove 45 is formed on an outer periphery of the large-diameter member 64. Further, the low lift cam 60 and the high lift cam 62 are the same as the low lift cam 40 and the high lift cam 42, respectively.

When a shift pin 51 is engaged with the guide groove 65, the first cam unit 6 can be slid so as to be switched to a low lift position or a high lift position. In other words, the guide groove 65 and the shift pin 51 (the actuator 5) constitute a first sliding mechanism configured to slide the first cam unit 6 such that the first cam unit 6 is switched between the low lift position and the high lift position.

The second cam unit 7 has a structure obtained by adding the removed rear part of the cam unit 4 to another cam unit that is the same as the cam unit 4 for the third cylinder 3 (#3). A sleeve 73 that is spline-connected to the intake camshaft 12 extends from a rear part of the first cylinder 3 (#1) to the second cylinder 3 (#2). The sleeve 73 is held by the second journal 17 of the engine 1 at a position between the first cylinder 3 (#1) and the second cylinder 3 (#2).

A low lift cam 70, an intermediate lift cam 71, and a high lift cam 72 configured to drive the rear-side intake valve 10 for the first cylinder 3 (#1) are fitted to a front end of the sleeve 73. The low lift cam 70, the intermediate lift cam 71, and the high lift cam 72 are also the same as the low lift cam 40, the intermediate lift cam 41, and the high lift cam 42 of the cam unit 4, respectively.

Further, two low lift cams 70 and one high lift cam 72 configured to drive the front-side intake valve 10 for the second cylinder 3 (#2) are provided in a substantially central part of the sleeve 73 in the front-rear direction so as to be arranged in the front-rear direction, and the low lift cam 70, the intermediate lift cam 71, and the high lift cam 72 configured to drive the rear-side intake valve 10 for the second cylinder 3 (#2) are provided in a rear end of the sleeve 73 so as to be arranged in the front-rear direction.

Note that the cams for the first cylinder 3 (#1) and the second cylinder 3 (#2) are provided at different phases so as to correspond to respective opening/closing timings of the intake valves 10. However, in order to easily distinguish the low lift cams 60, 70, the intermediate lift cam 71, and the high lift cams 62, 72 from each other in FIG. 6, that is, for purposes of the description, the cams 60, 62, 70, 71, 72 are illustrated at the same phase. This applies to FIGS. 7, 8.

Further, similarly to the sleeves 43, 63, a large-diameter member 74 is fitted to an outer periphery of the sleeve 73, and a guide groove 75 having the same shape as the shape of the guide grooves 45, 65 is formed on an outer periphery of the large-diameter member 74. When the shift pin 51 is engaged with the guide groove 75, the second cam unit 7 can be slid so as to be switched to a low lift position, an intermediate lift position, or a high lift position. In other words, the guide groove 75 and the shift pin 51 (the actuator 5) constitute a second sliding mechanism configured to slide the second cam unit 7 such that the second cam unit 7 is switched among the low lift position, the intermediate lift position, and the high lift position.

Thus, in the present embodiment, the guide grooves 65, 75 for allowing the first and second cam units 6, 7 to slide, respectively, have the same shape. Therefore, when respective shift pins 51 are engaged with the guide grooves 65, 75, the first and second cam units 6, 7 slide in synchronization with each other. Accordingly, the lift characteristics of the intake valves 10 for the first cylinder 3 (#1) and the second cylinder 3 (#2) are changed at the same timing, thereby making it possible to avoid occurrence of a situation in which a large variation in an intake air charging amount between the cylinders is caused when the lift characteristics of the intake valves 10 are changed.

Further, the slide amount for switching the second cam unit 7 in the three stages is twice as large as the slide amount S for switching the first cam unit 6 in the two stages. Accordingly, in order to operate the first cam unit 6 and the second cam unit 7 in synchronization with each other, an appropriate distance is required between the first cam unit 6 and the second cam unit 7. In the present embodiment, when the first cam unit 6 is placed at the low lift position and the second cam unit 7 is placed at the intermediate lift position as illustrated in FIG. 7, a minimum gap C (e.g., a gap corresponding to twice as large as a dimensional tolerance) is formed between the first cam unit 6 and the second cam unit 7 such that the first cam unit 6 does not make contact with the second cam unit 7.

Figure 7:
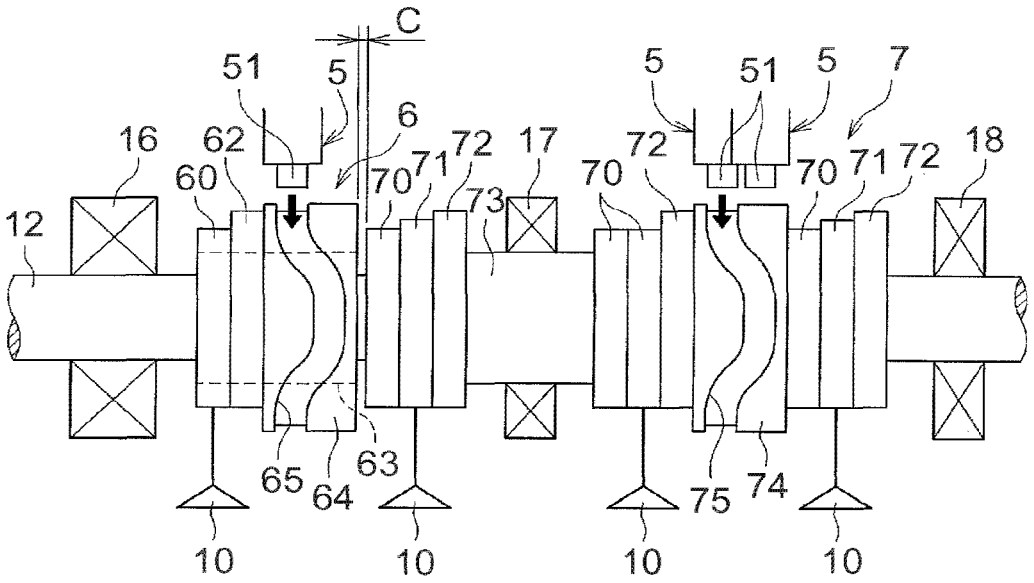
FIG. 7 is a view corresponding to FIG. 6, FIG. 7 illustrating an intermediate lift state.
Figure 8:
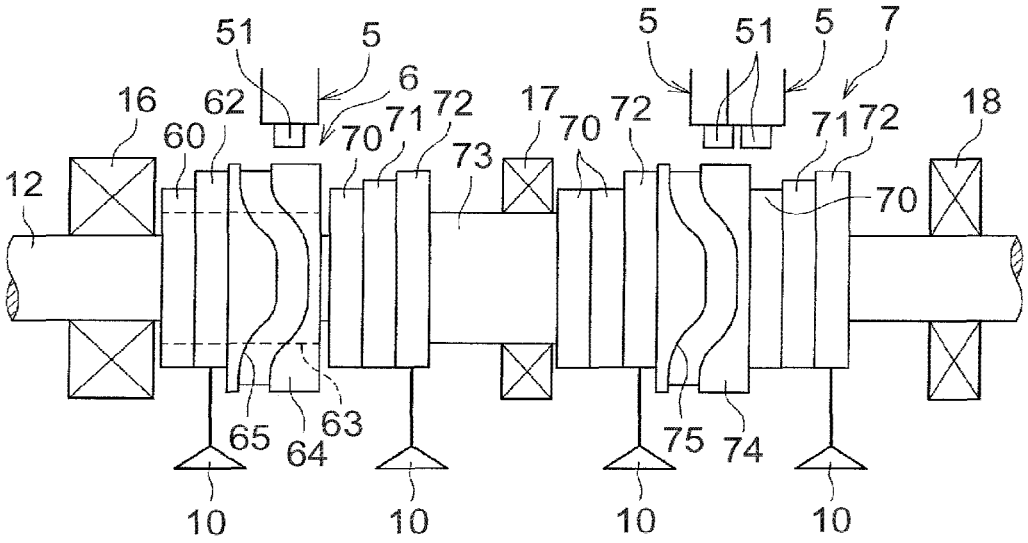
FIG. 8 is a view corresponding to FIG. 6, FIG. 8 illustrating a high lift state.
Figure 9:
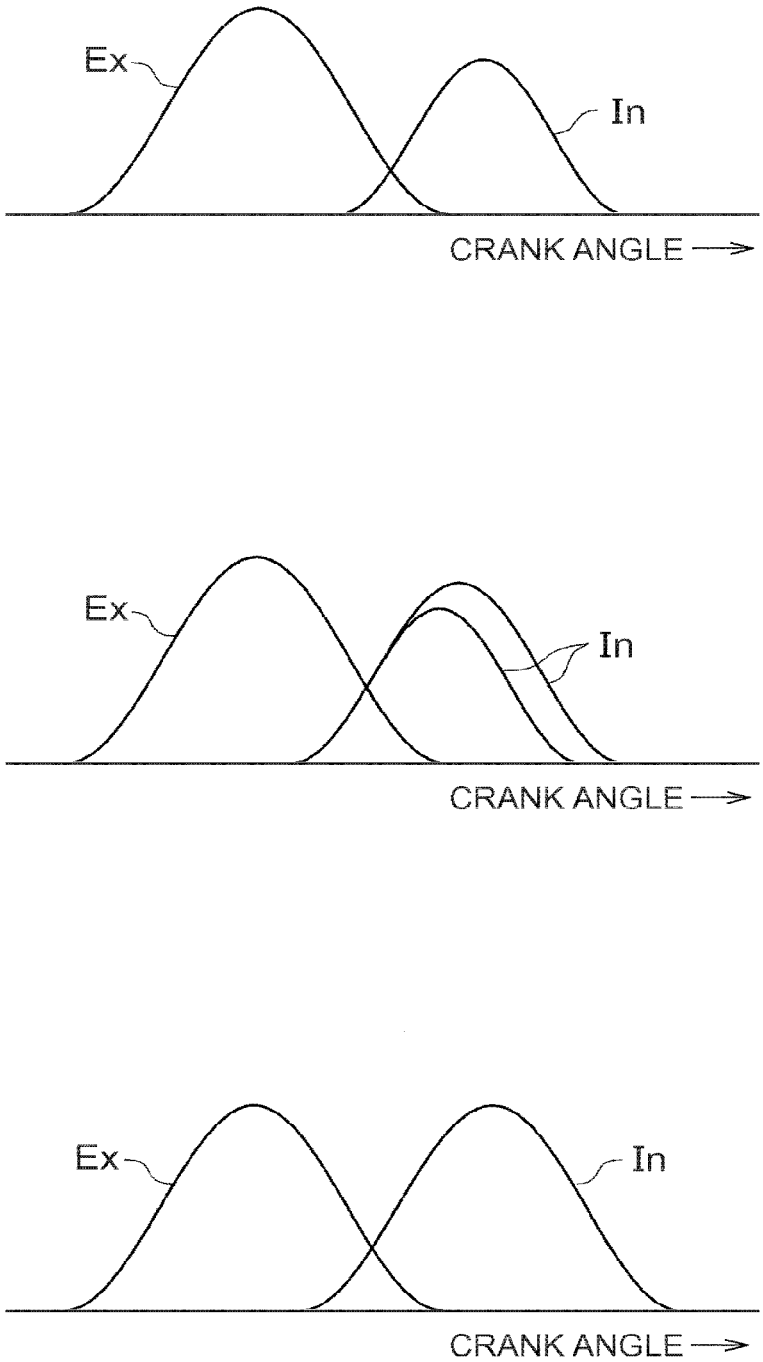
FIG. 9 is a view illustrating changes in lift characteristics of intake valves by switching among cams.

The following describes sliding of the first and second cam units 6, 7, that is, the operations of the cam switch mechanism in the first and second cylinders 3, with reference to FIGS. 7 to 9 in addition to FIG. 6. Note that the same operation as the operation of the cam unit 4 for the third cylinder 3 (#3) described above with reference to FIGS. 2 to 5 will be described briefly.

In a low lift state during the operation of the engine 1, the first and second cam units 6, 7 are both placed at the low lift positions as illustrated in FIG. 6. That is, as illustrated in an upper side in FIG. 9, all the intake valves 10 for the first cylinder 3 (#1) and the second cylinder 3 (#2) are in the low lift state. Note that a left lift curve Ex in FIG. 9 indicates a lift curve of an exhaust valve 11, and a right lift curve In indicates a lift curve of the intake valve 10.

In the low lift state, the rear-side actuator 5 for the second cylinder 3 (#2) is turned on so as to cause the shift pin 51 to advance as indicated by a black arrow in FIG. 6 such that the shift pin 51 is engaged with the front-side straight groove of the guide groove 75 of the second cam unit 7. Thus, the shift pin 51 relatively moves along a curved shape of the guide groove 75 along with the rotation of the intake camshaft 12 and the second cam unit 7, similarly to the cam unit 4 for the third cylinder 3 (#3) described above with reference to FIG. 5.

Thus, the second cam unit 7 practically slides toward the front side, so that the second cam unit 7 is switched to the intermediate lift position as illustrated in FIG. 7. At the intermediate lift position, the intermediate lift cam 71 is selected for the rear-side intake valve 10 for the first cylinder 3 (#1), and the low lift cam 70 and the intermediate lift cam 71 are selected for the front-side intake valve 10 and the rear-side intake valve 10 for the second cylinder 3 (#2), respectively.

Accordingly, as schematically illustrated in a center in FIG. 9, respective front-side intake valves 10 for the first cylinder 3 (#1) and the second cylinder 3 (#2) are in the low lift state, and respective rear-side intake valves 10 for the first cylinder 3 (#1) and the second cylinder 3 (#2) are in an intermediate lift state. That is, each of the first cylinder 3 (#1) and the second cylinder 3 (#2) is brought to the intermediate lift state between a small lift state and a large lift state, as a whole. Note that, when the first cam unit 6 is placed at the low lift position and the second cam unit 7 is placed at the intermediate lift position, the gap C is formed between the first cam unit 6 and the second cam unit 7, and thus, they do not interfere with each other.

Subsequently, in the intermediate lift state, the actuator 5 for the first cylinder 3 (#1) and the front-side actuator 5 for the second cylinder 3 (#2) are turned on, so as to cause the respective shift pins 51 to advance as indicated by black arrows in FIG. 7. Thus, when the respective shift pins 51 engage with the guide grooves 65, 75 of the first and second cam units 6, 7, the first and second cam units 6, 7 slide toward the front side in synchronization with each other, and thus, the first and second cam units 6, 7 are switched to the high lift positions.

Thus, as illustrated in FIG. 8, in the first cam unit 6, the high lift cam 62 is selected for the front-side intake valve 10 for the first cylinder 3 (#1), and also in the second cam unit 7, the respective high lift cams 72 are selected for the rear-side intake valve 10 for the first cylinder 3 (#1) and the front-side and rear-side intake valves 10 for the second cylinder 3 (#2). Accordingly, as schematically illustrated in a lower side in FIG. 9, all the intake valves 10 for the first cylinder 3 (#1) and the second cylinder 3 (#2) are in the high lift state.

Although detailed explanations are omitted, an operation for switching the state of the intake valves 10 from the high lift state to the intermediate lift state and further to the low lift state is opposite to the above operation. That is, for example, in FIG. 8, when the respective shift pins 51 are engaged with the rear-side straight grooves of the guide grooves 65, 75 of the first and second cam units 6, 7, it is possible to switch the state of the intake valves 10 from the high lift state to the intermediate lift state described with reference to FIG. 7.

Next, a fail-safe at the time when a failure occurs in the actuator 5 for sliding the first cam unit 6 will be described, with reference to FIG. 10. As illustrated in FIG. 6, when both of the first and second cam units 6, 7 are placed at the low lift positions, all the intake valves 10 for the first cylinder 3 (#1) and the second cylinder 3 (#2) are in the low lift state (see the upper side in FIG. 9).

Figure 10:
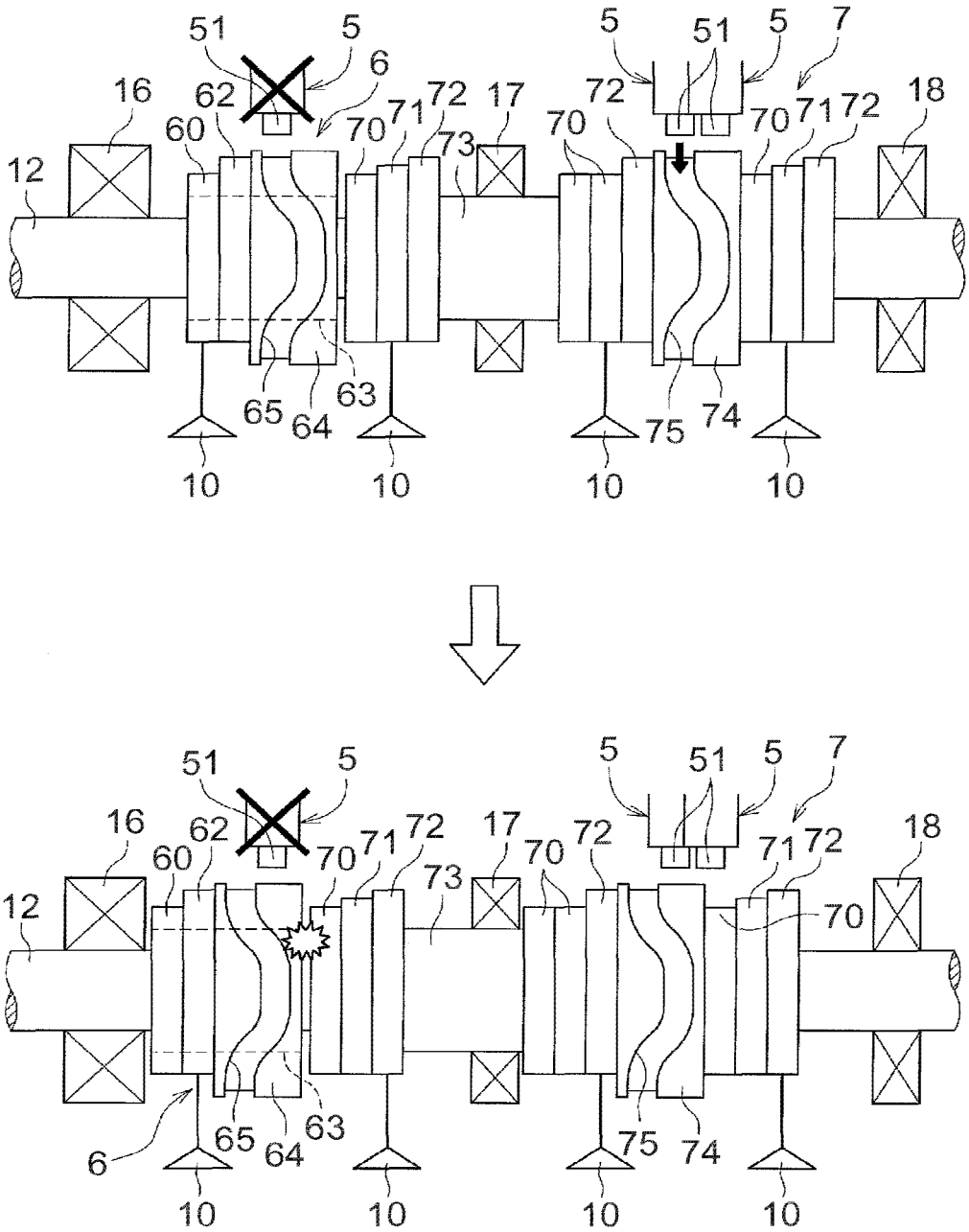
FIG. 10 is a view illustrating a fail-safe operation.

At this time, a case is assumed in which a failure occurs in the actuator 5 for the first cam unit 6 as illustrated in an upper side in FIG. 10 and the first cam unit 6 cannot be slid (an "X" mark is shown on the actuator 5 in the figure to indicate that a failure occurs in the actuator 5). As a result, the front-side intake valve 10 for the first cylinder 3 (#1) remains in the low lift state. Accordingly, even if the rear-side intake valve 10 is brought to the high lift state, the efficiency of charging intake air to the first cylinder 3 (#1) becomes insufficient.

In this regard, in the present embodiment, when the actuator 5 for the second cam unit 7 is operated so as to switch the second cam unit 7 to the intermediate lift position, the gap C is just formed between the first cam unit 6 and the second cam unit 7 as described above with reference to FIG. 7. Accordingly, by sliding the second cam unit 7 further toward the front side from the intermediate lift position such that the second cam unit 7 is switched to the high lift position, the first cam unit 6 also slides toward the front side as illustrated in a lower side in FIG. 10 such that the first cam unit 6 is switched to the high lift position.

As described above, the engine 1 of the present embodiment has an overall length that is shortened as much as possible in order to increase its mountability on the vehicle. As a result, the distance between the first journal 16 that holds the front part of the intake camshaft 12 and the front-side intake valve 10 for the first cylinder 3 (#1) is extremely small. In view of this, as described above, the first cam unit 6 for the front-side intake valve 10 for the first cylinder 3 (#1) is configured to be switched between the two stages, that is, the low lift position and the high lift position, and thus, the slide amount S for the switching is made small so as to prevent interference with the first journal 16.

The cams 70 to 72 configured to drive the rear-side intake valve 10 for the first cylinder 3 (#1) are integrated with the second cam unit 7 for the two intake valves 10 for the second cylinder 3 (#2). By sliding the second cam unit 7 to switch the rear-side intake valves 10 for the first cylinder 3 (#1) and the second cylinder 3 (#2) among the three stages, that is, the low lift position, the intermediate lift position, and the high lift position, it is also possible to switch the state of the first cylinder 3 (#1) among the three stages.

Thus, even in a case where a space in the front end of the cam housing 2 for accommodating a valve system of the engine 1 is narrow, it is possible to change the lift characteristics of the intake valves 10 in three stages by sliding the cam units 4, 6, 7 for the cylinders 3.

The present invention is not limited to the configuration described in the above embodiment. The above embodiment is simply an example, and the configuration, the purpose, and the like of the present invention is not limited. For example, in the above embodiment, two low lift cams 70 and one high lift cam 72 are provided so as to change the lift characteristic of the front-side intake valve 10 for the second cylinder 3 (#2) between the two stages, that is, the high lift position and the low lift position by sliding the second cam unit 7. However, the present invention is not limited to this configuration.

That is, kinds of the cams configured to drive the front-side intake valve 10 for the second cylinder 3 (#2) in the second cam unit 7 may be the same as the cams of the first cam unit 6, and for example, one low lift cam 70 and two high lift cams 72 may be provided. Further, in the above embodiment, each of the low lift cams 40, 60, 70 may be a zero-lift cam.

Further, in the above embodiment, the guide groove 45 (or 65 or 75) for allowing the cam unit 4 (or 6 or 7) to slide includes two straight grooves 45*a*, 45*b* and two curved grooves 45*c*, 45*d*. However, the present invention is not limited to this configuration, and well-known guide grooves having various shapes may be provided. The well-known guide grooves include a Y-shaped guide groove as described in JP 2010-520395 A. Further, the present invention is not limited to the guide groove, and a guide portion having a shape that engages with the shift pin 51 so as to slide the cam unit 4, 6, or 7 may be provided.

Further, in the above embodiment, as illustrated in FIG. 7, when the first cam unit 6 is placed at the low lift position and the second cam unit 7 is placed at the intermediate lift position, the minimum gap C is formed between the first cam unit 6 and the second cam unit 7 such that the first cam unit 6 does not make contact with the second cam unit 7. However, the present invention is not limited to this configuration, and a larger gap C may be formed. In consideration of the fail-safe at the time when a failure occurs in the actuator 5 for the first cam unit 6, a size of the gap C should be less than half of one slide amount S of each of the cam units 4, 6, and 7.

Further, in the above embodiment, the first cam unit 6 that is switched between the two stages is provided for the front-side intake valve 10 for the first cylinder 3 (#1) close to the front end of the engine 1. However the present invention is not limited to this configuration, and a cam unit that is switched between two stages may be provided for the rear-side intake valve 10 for the fourth cylinder 3 (#4) close to the rear end of the engine 1, and a cam configured to drive the front-side intake valve 10 for the fourth cylinder 3 (#4) may be integrated with the cam unit 4 for the third cylinder 3 (#3).

According to the present invention, even in a case where a space in one end of a valve system of an engine is narrow, it is possible to switch among cams in three stages by a cam-switching variable valve mechanism. Accordingly, the present invention is highly effective when the present invention is applied to an engine provided in an automobile, for example.

What is claimed is:

1. A variable valve mechanism provided in a multi-cylinder engine in which at least two cylinders including a first cylinder and a second cylinder are provided in a stated order from a first side to a second side in a cam axial direction and two intake valves are provided for each of the at least two cylinders, the variable valve mechanism being configured to drive the intake valves, the variable valve mechanism comprising:

a first cam unit provided around an intake camshaft and including a plurality of cams configured to drive an intake valve on the first side in the cam axial direction in the first cylinder;

a first sliding mechanism configured to slide the first cam unit in the cam axial direction such that the first cam unit is switched between two positions to select any one of the plurality of cams;

a second cam unit provided around the intake camshaft and including a plurality of cams configured to drive an intake valve on the second side in the cam axial direction in the first cylinder, a plurality of cams configured to drive an intake valve on the first side in the cam axial direction in the second cylinder, and a plurality of cams configured to drive an intake valve on the second side in the cam axial direction in the second cylinder; and a second sliding mechanism configured to slide the second cam unit in the cam axial direction such that the second cam unit is switched among three positions to select any one of the plurality of cams for each of the intake valve on the second side in the cam axial direction in the first cylinder, the intake valve on the first side in the cam axial direction in the second cylinder, and the intake valve on the second side in the cam axial direction in the second cylinder.

2. The variable valve mechanism according to claim 1, wherein:

in the first cam unit, a small cam and a large cam larger than the small cam are provided;

in the second cam unit, the small cam, the large cam, and an intermediate cam having a size between a size of the small cam and a size of the large cam are provided for each of the intake valve on the second side in the cam axial direction in the first cylinder and the intake valve on the second side in the cam axial direction in the second cylinder, and the small cam and the large cam are provided for the intake valve on the first side in the cam axial direction in the second cylinder.

3. The variable valve mechanism according to claim 2, wherein in the second cam unit, a plurality of the small cams are provided for the intake valve on the first side in the cam axial direction in the second cylinder.

4. The variable valve mechanism according to claim 1, wherein the first sliding mechanism and the second sliding mechanism are configured to slide the first cam unit and the second cam unit in synchronization with each other.

5. The variable valve mechanism according to claim 1, wherein:

a predetermined gap is formed between the first cam unit and the second cam unit when the first cam unit is placed at a second position on the second side out of the two positions including a first position on the first side and the second position on the second side in the cam axial direction and the second cam unit is placed at a central position among the three positions including a third position on the first side, a fourth position on the second side, and the central position between the third position on the first side and the fourth position on the second side in the cam axial direction; and when the second cam unit is slid from the central position by the second sliding mechanism so as to be switched to the third position on the first side in the cam axial direction, the first cam unit is pressed by the second cam unit so as to be switched to the first position on the first side in the cam axial direction.

* * * * *